US005762194A

United States Patent [19]

Clegg

[11] Patent Number: 5,762,194

[45] Date of Patent: Jun. 9, 1998

[54] DELIVERY SYSTEM WITH SPECIAL EFFECTS

[75] Inventor: Timothy P. Clegg, Torrance, Calif.

[73] Assignee: Clegg Industries, Inc., Torrance, Calif.

[21] Appl. No.: 573,068

[22] Filed: Dec. 15, 1995

[51] Int. Cl.[6] ..... B65D 85/48

[52] U.S. Cl. ..... 206/449; 206/459.1; 206/232; 40/455

[58] Field of Search ..... 206/449, 459.5, 206/459.1, 232, 37.1, 455, 214, 371; 40/124.1, 455, 717

[56] References Cited

U.S. PATENT DOCUMENTS

| | | | |
|---|---|---|---|
| 3,594,937 | 7/1971 | Luchsinger | 40/455 |
| 3,766,882 | 10/1973 | Babbitt, III | 206/459.1 |
| 3,798,806 | 3/1974 | Sanford | 40/455 |
| 4,102,067 | 7/1978 | Tarrant | 40/455 |
| 4,528,933 | 7/1985 | Allen | 206/459.1 |
| 4,607,747 | 8/1986 | Steiner | 206/232 |
| 5,099,232 | 3/1992 | Howes . | |
| 5,275,285 | 1/1994 | Clegg . | |
| 5,283,567 | 2/1994 | Howes | 206/217 |
| 5,464,092 | 11/1995 | Seeley | 206/217 |

*Primary Examiner*—B. Dayoan
*Assistant Examiner*—Nhan T. Lam
*Attorney, Agent, or Firm*—Jeffer, Mangels, Butler & Marmaro LLP

[57] ABSTRACT

A delivery system for delivering an item accompanied by special effects such as sound is described. The delivery system includes a tube having a cap. Connected to the cap is a sound emitting device, a light sensor and a clip for holding, for example, a card. The sound emitting device and clip are connected to the cap so that when the cap is on the container, the sound emitting device, light sensor and clip are disposed within the container. The card can be attached to the clip. When the cap is removed, the light sensor triggers the sound emitting device to emit a sound such as musical notes or applause, and the card can then be viewed by the recipient of the container simultaneously with listening of the sound.

23 Claims, 4 Drawing Sheets

DELIVERY SYSTEM WITH SPECIAL EFFECTS

FIELD OF THE INVENTION

This invention relates to a delivery system for delivering items in an enclosure whereby when the item is delivered and viewed by the recipient, the recipient also encounters a special effect such as a sound. The system is particularly useful in connection with advertising and promotion, and is also particularly useful in connection with the mailing of items.

BACKGROUND OF THE INVENTION

It is known to deliver greetings via a greeting card. Greeting cards with sound generating chips are also known whereby upon opening the greeting card, a sound is played.

Business card holders are also known, including business card holders with sound generating microchips. See U.S. Pat. No. 5,275,285 assigned to Clegg Industries.

A simulated product container (e.g., can of beer) is also known for delivering a prize accompanied by a sound or message. The container typically includes a mechanically activated sound or message generating device and a holder for the prize disposed within the container but not attached to the top of the container. The container is filled with a liquid or dry material to simulate the weight and feel of the simulated product. The container is not intended to be mailed. See U.S. Pat. No. 5,099,232.

Mailing tubes having labels thereon are also known. It is further known to include rolled up within such mailing tubes blueprints, letters, posters, and the like, and to mail such mailing tubes to recipients.

SUMMARY OF THE DISCLOSURE

The present invention is directed to a delivery system for delivering items such as business cards, photos, credit cards, pens and any other item, while at the same time when delivering those items, presenting the recipient of the item with a special effect such as a telephone ringing sound, business jingle, announcement sound, a message, a combination of words or musical tones, sound effects, a smell, a vibration, an image, light effects, video effects or the like. In a preferred embodiment of the present invention, there is provided a tube having an aperture, a cover adjacent the aperture, and a special effects emitting device. Preferably, further provided is means, connected to the cover or special effects emitting device, for holding an item. When the cover is adjacent the aperture, the special effects emitting device does not emit a special effect, and preferably the means for holding an item holds the item within the tube. When the cover is displaced from the aperture, the special effects emitting device becomes operational emitting a special effect, and preferably the recipient of the tube can view the item held by the holding means while the special effect is being emitted. This system is particularly useful when special attention is to be drawn to the held item.

Other features and advantages of the invention will become apparent from the following detailed description, taken in conjunction with the accompanying drawings which illustrate, by way of example, various features of preferred embodiments of the invention.

BRIEF DESCRIPTION OF THE DRAWINGS

The detailed description of the disclosure will be made with reference to the accompanying drawings, where like numerals designate corresponding parts of the figures.

DETAILED DESCRIPTION OF THE DISCLOSURE

In general, the present invention preferably includes an at least partially hollow receptacle for holding an item in the hollow, the receptacle having an aperture communicating with the hollow, a cap for at least partially covering the aperture, and a special effects emitting device associated with the receptacle and cap and which is disposed such that when the cap is displaced from the aperture, the special effects emitting device emits a special effect.

In preferred embodiments of the present invention, the receptacle is for holding and delivering cards with messages or information thereon simultaneously with producing a special effect such as a sound which actively draws attention to the enclosed card or other item. However, it will be recognized that further embodiments of the invention may be used to hold other objects that are similarly sized, including but not limited to photos, credit cards, pens, pencils, stickers, caps, pins, jewelry or the like. The present invention can also hold multiple items. In this regard, preferably the receptacle has a relatively large volume in comparison to the item being delivered.

Figure 1:
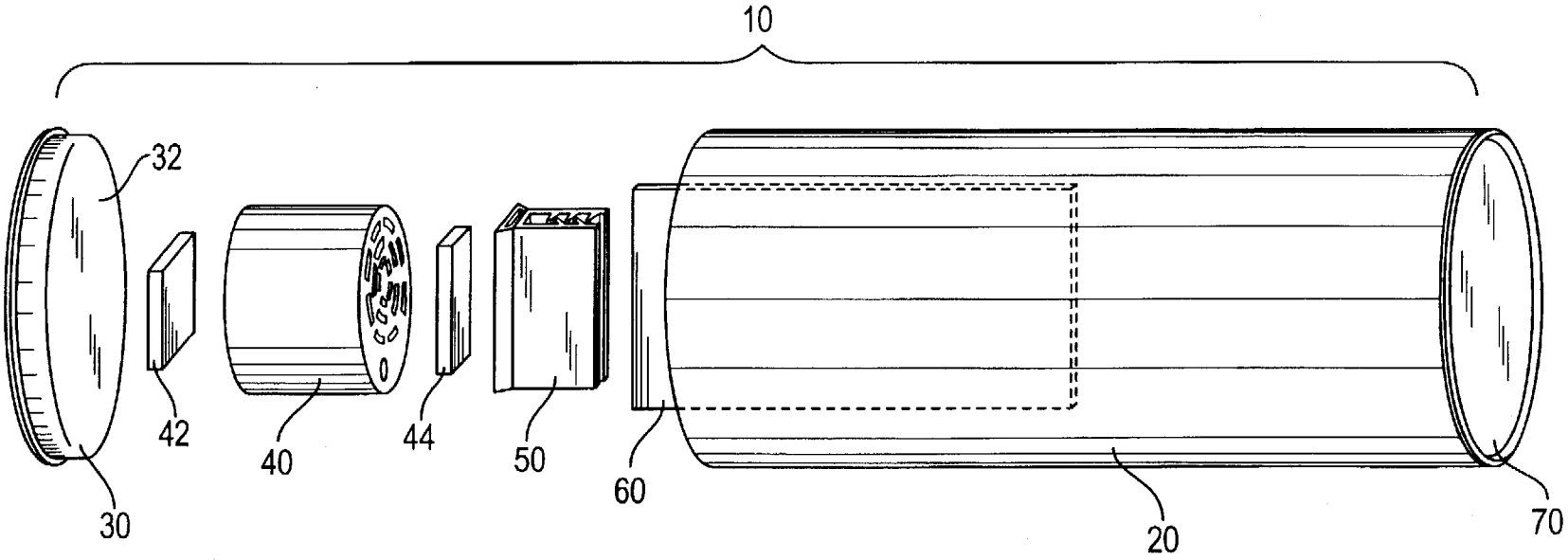
FIG. 1 is an exploded perspective view of a preferred embodiment of the delivery system of the present invention.
Figure 2:
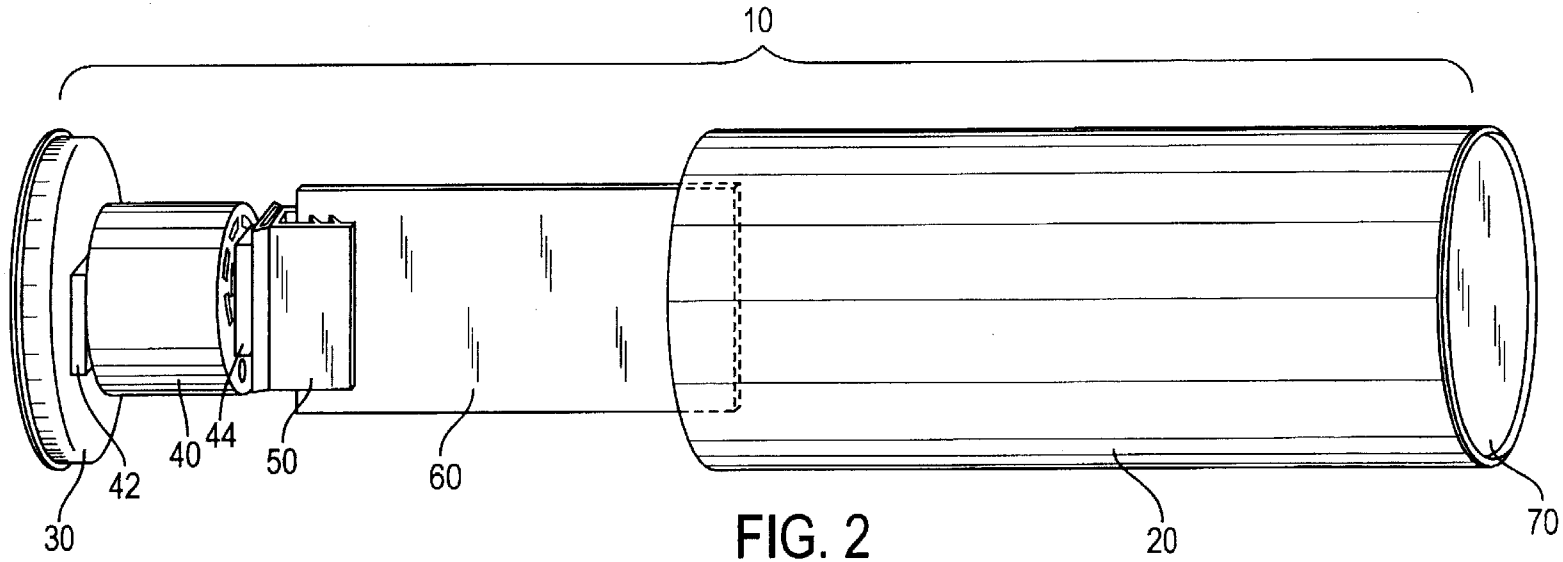
FIG. 2 is a side view of a preferred embodiment of the delivery system of the present invention with the cover removed.
Figure 3:
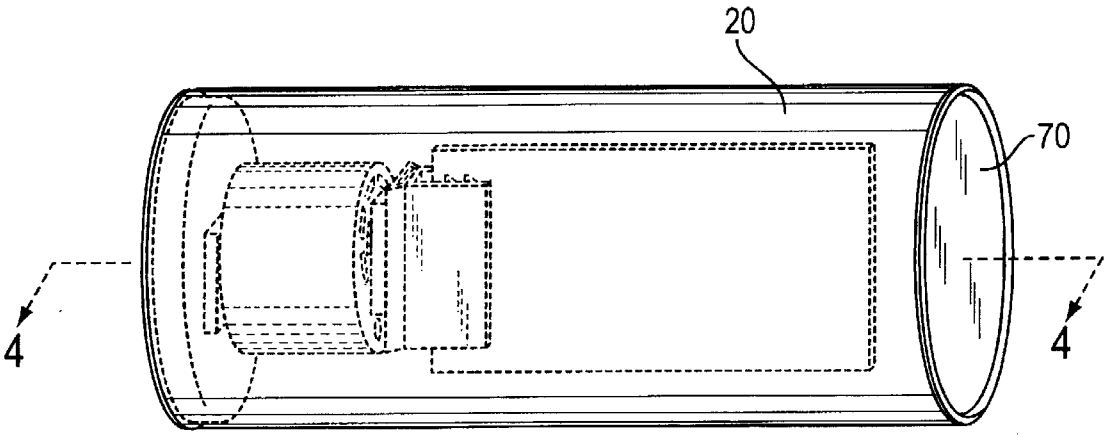
FIG. 3 is a side view of a preferred embodiment of the delivery system of the present invention with the cap cover in place on the tube.
Figure 4:
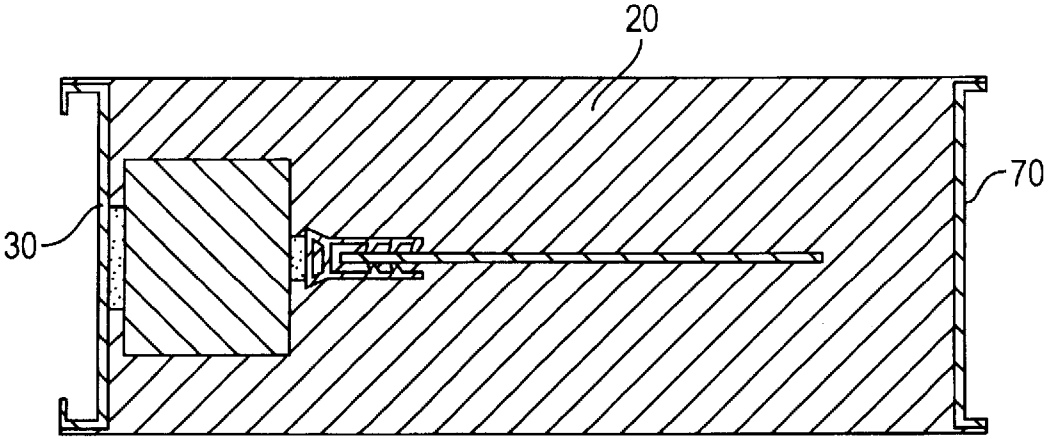
FIG. 4 is a cross-sectional view of the preferred embodiment of the delivery system of the present invention shown in FIG. 3 and taken along line 4—4.

As shown in the drawings for purposes of illustration only, the invention is preferably embodied in a receptacle for delivering an item. FIG. 1 shows an exploded perspective view of one preferred embodiment of the delivery system of the present invention. This embodiment of the present invention is designed to hold a single item such as a business card.

As shown in FIG. 1, one embodiment of the delivery system generally 10 is comprised of a cylindrical tube 20, a top cap 30, a housing 40, a clip 50, a card 60 and a bottom cap 70. The top cap 30 is preferably dimensioned to snugly fit into the top aperture of the tube, and the opposed end of the tube is sealed with another cap 70 such as a metal cap. The caps 30 and 70 may be of the snap-in, twist-on, or pressure fitted type. The cap 30 may completely or partially cover the aperture, but preferably it completely covers the aperture of the tube and is pressure fitted.

The caps 30 and 70 may be made of plastic and injection molded, and the tube made of pressboard. The caps can also be made of metal, wood or paper. Preferably the caps are of unitary construction. The tube may be made from rolled chipboard, coated paper stock, paperboard, cardboard, plastic, metal or the like. The tube can be cylindrical, round, oblong or generally of any shape. Preferably most of the volume of the tube hollow is not filled with a liquid or dry powder, but is merely used for disposing the item to be delivered.

The cap to which is preferably attached a sound generating or special effect generating or emitting device, draws the attention of the recipient to the item inside by emitting audio signals such as sounds, voice messages, speech, sound effects, musical melodies, tones and/or video images and effects or the like.

For example, preferably the sound emitting device includes a speaker and creates a sound which instills a memory cue in the recipient, so that the recipient more readily remembers the received card and retains it for longer periods of time. Therefore the delivery system of the present invention can be used as a very effective advertisement or promotional device.

The sound emitting device (not shown) is housed in the plastic housing 40. The sound emitting device used in the illustrated embodiment of the present invention is a sound generating microchip, for example, but not limited to a Sound Generator Model HT-2812 1 produced by Holtek Microelectronics Inc. of Taiwan R.O.C. Such microchip devices may be configured to produce a variety of sounds or messages, such as telephone ringing, business jingles, fan fare, sports car, voice messages, speech, applause, door bells, sound effects, musical melodies, tones or the like.

As an alternative to the sound emitting device is an image producing device, for example, a video player, a Liquid Crystal Display (LCD) or Light Emitting Diode (LED) which when activated could spell out a message, logo or advertising slogan. Such devices are well known to those of skill in the art.

Figure 5:
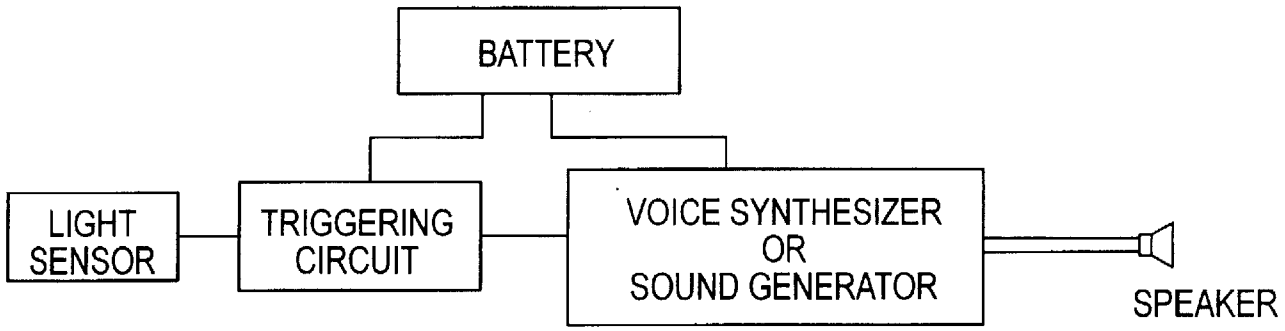
FIG. 5 is a block diagram of a preferred embodiment of the present invention.

Operatively connected to the sound emitting device is a light sensor (not shown), speaker (not shown) and a battery (not shown). See FIG. 5. The light sensor is housed in the housing 40. The light sensor device is preferably a light dependent resistor, which is used to detect the presence or absence of light, for example, but not limited to Model CD5G207 produced by Cosmos Electronics Inc. of Tokyo, Japan. Generally when the cap is displaced from the aperture of the tube such that light contacts the light sensor, the special effects generating device becomes operational to thereby generate a special effect. It should be appreciated that other alternatives to the light sensor are within the scope of the present invention such as a mechanical trigger release switch or the like that would be in an "off" position while the cover closes off the aperture. When the cover is displaced from the aperture, the special effects emitting device would become operational.

If the item to be delivered is a card, the clip 50 is preferably a plastic pressure clip. Other clips and/or means for holding items are also suitable. More than one clip can be provided and/or one clip can be designed to hold several items. The clip can be attached to the cap, or be spring loaded and inside the tube when the cap is on such that when the cap is off, the clip pops up and the item is outside of the tube. The clip can also be replaced and/or augmented with an adhesive, velcro, snaps or like means for holding an item. The holder can hold the item, or the item can be integral with the holder. The present invention also contemplates the receptacle of FIG. 1 without the clip 50 (and the adhesive pad 44 as discussed below).

The housing 40 is preferably connected by adhesive pad 42 to the under surface 32 of the cap 30. The clip 50 is preferably connected by adhesive pad 44 to the housing 40. The adhesive pad may partially block the openings shown in the cap 40. The clip 50 may be made integral with the housing 40 and/or the cap 30. The housing 40 and the clip 50 may be directly connected to the underside of the cap 30 by connecting means such as glue or the like.

In the configuration shown, the special effects generating device and the light sensor are contained within housing 40 which is connected to cap 30. In alternate embodiments, the light sensor and/or special effects generating device may be connected to the inside of the tube 20; whereby in all cases, the removal of the cap 30 causes the special effects generating device to emit a special effect and allows the recipient to remove the item held by the holding means inside of the tube.

In one preferred embodiment, the delivery system includes a tube. In alternative embodiments, the tube may be replaced with longer or shorter tubes, it could be a box, or any other shape of a receptacle whereby the receptacle is hollow enough to hold an item and the receptacle has some type of cap which can be removed from an aperture in the receptacle which communicates with the hollow.

The tube of the present invention can be used to mail an item. The tube can include a message on a label on the outside of the tube. In one preferable embodiment, the label begins a message, e.g., "When You're the Best . . . ", and the holder holds a card (e.g., a card having business information) which concludes the message, e.g., "Give Me a Call".

While the description above refers to particular embodiments of the present invention, it will be understood that many modifications may be made without departing from the spirit thereof. The accompanying claims are intended to cover such modifications as would fall within the true scope and spirit of the present invention.

The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

What is claimed is:

1. A receptacle comprising:

a cylindrically-shaped hollow container having an aperture;

a cover for the aperture;

means for emitting a sound; and means connected to the cover for holding an item, wherein the means for emitting a sound is connected to the cover, is operational to emit sounds upon uncovering the aperture, and comprises an electronic sound generating device, a light sensor, a battery and a speaker, and wherein the light sensor activates the sound generating device.

2. The receptacle according to claim 1, wherein the cylindrically-shaped hollow container is made of rolled chipboard.

3. The receptacle according to claim 2, wherein the cover is injected molded.

4. The receptacle according to claim 1, wherein the outside of the container has affixed thereto a label.

5. The receptacle of claim 4 further including a card held by the holding means.

6. The receptacle of claim 5 wherein on the label appears a portion of a message and wherein the remainder of the message appears on the card.

7. The receptacle according to claim 1, wherein the holding means is a clip.

8. A receptacle according to claim 1, wherein the sound generating device generates sound effects selected from the group consisting of a ringing phone, applause, fanfare, a sports car, door bells, spoken words, sung words, musical melodies, or mixtures thereof.

9. The receptacle according to claim 1, wherein the cover, sound emitting means and holding means are connected in seriatim.

10. The receptacle according to claim 1, wherein the electronic sound generating device generates a musical arrangement of tones.

11. A receptacle comprising:

a cylindrically-shaped hollow container having an aperture;

a cover for the aperture;

means for emitting a sound; and means connected to the cover for holding an item, wherein the means for emitting a sound is connected to the cover, is operational to emit sounds upon uncovering the aperture and wherein said sound emitting means comprises an electronic sound generating device, a light sensor, a battery and a speaker, and wherein the light sensor activates the sound generating device and further including a housing wherein the sound generating device, light sensor, battery and speaker are contained within the housing.

12. The receptacle according to claim 11, wherein when the cover is covering the aperture of the container, the housing is disposed within the container.

13. A container for delivering an item accompanied by a special effect, the container comprising:

a receptacle having a hollow and an aperture communicating with the hollow;

a cover for the aperture;

a special effects generating device;

means responsive to light for activating the special effects generating device, whereby when the cover is moved away from the aperture, the special effects generating device generates a special effect; and a clip disposed within the container when the cover is adjacent the aperture.

14. The container of claim 13 further comprising a card.

15. The container of claim 13 further comprising a label affixed to the receptacle.

16. The container of claim 13 wherein the activating means is a light sensor.

17. The container of claim 13 wherein at least a portion of the cover fits snugly within the aperture.

18. The container of claim 17 wherein the special effects generating device is disposed within the receptacle when the aperture is covered.

19. The container of claim 13 further including a housing and wherein the special effects generating device and activating means are housed together in the housing and wherein said housing is adhesively affixed to the cover and the clip is adhesively affixed to the housing opposite said cover.

20. The container of claim 19 wherein said activating means is a light sensor.

21. A method for mailing an item with an accompanying sound to a recipient at a destination, the method comprising:

providing a tubular container having (i) a cover, (ii)sound emitting means comprising an electronic sound generating device, a light sensor, a battery and a speaker and (iii) a clip, the clip being disposed within the container when the cover is on the container, the sound generating device generating a sound when the cover is removed from the container and the light sensor is activated;

connecting the item to the clip;

placing the cover on the container;

mailing the container to the recipient at the destination; and removing the cover from the container and exposing the light sensor to light to thereby generate a sound and deliver the item to the recipient.

22. A sound generating device container comprising:

a tube having an open end;

a cap dimensioned to snugly fit within the open end and to cover the open end;

a clip associated with the cap;

a sound generating associated with the cap;

a light sensor associated with the cap, wherein the clip, sound generating device and light sensor are associated with the cap such that they are disposed within the container when the cap is covering the open end of the tube and such that when the clip passes through the open end of the tube the sound generating device generates a sound.

23. A business card information holder comprising:

a tube;

a cap associated with the tube;

sound emitting means comprising an electronic sound generating device, a light sensor, a battery and a speaker, said sound emitting means being operational when the cap is disassociated from the tube; and a holder which displays business card information simultaneously with disassociation of the cap from the tube and activation of the light sensor and the generation of a sound.

* * * * *